United States Patent [19]

Horner

[11] Patent Number: 4,603,689

[45] Date of Patent: Aug. 5, 1986

[54] PATIENT OPERATED DEVICE AND METHOD FOR APPLYING TRACTION TO THE LOWER BACK VERTEBRA OF A PATIENT IN A SEATED POSITION

[76] Inventor: John A. Horner, 211 E. Grove St., Kawkawlin, Mich. 48631

[21] Appl. No.: 712,189

[22] Filed: Mar. 15, 1985

[51] Int. Cl.[4] ..... A61H 1/02

[52] U.S. Cl. ..... 128/75; 128/78

[58] Field of Search ..... 128/75, 78, 84; 24/134 P

[56] References Cited

U.S. PATENT DOCUMENTS

| | | | |
|---|---|---|---|
| 2,627,834 | 2/1953 | Roberts et al. | 24/134 P |
| 2,701,564 | 2/1955 | Wilhelm | 128/75 |
| 3,118,441 | 1/1964 | George | 128/75 |
| 3,585,992 | 6/1971 | Vessels | 128/75 |
| 4,269,179 | 5/1981 | Burton et al. | 128/75 |

FOREIGN PATENT DOCUMENTS

| | | | |
|---|---|---|---|
| 7535760 | 11/1975 | France | 128/75 |

OTHER PUBLICATIONS

"Apparatus for Head Traction", by Hamby, *J.A.M.A.*, p. 182, May 21, 1955.

*Primary Examiner*—Robert P. Swiatek
*Assistant Examiner*—David I. Tarnoff
*Attorney, Agent, or Firm*—Learman & McCulloch

[57] ABSTRACT

A method and device for self-applying natural traction to the lower spinal region with an elongate generally vertical frame contoured to fit the backrest portion of a furniture piece having a seat, the frame having an upwardly extending portion with a pulley system mounted thereon at a substantial level above the backrest. A cable is trained around the pulley system and a removable belt attached to one end of the cable is adapted to be secured around the lower thoracic region of the user. The other end of the cable is free and is passed through a releasable gripper device mounted on the frame to hang therebelow. The frame is first placed on the backrest of the furniture piece such that the pulley system and free end of the cable overlie the seat. Then a seated position in the chair is taken and the belt is snugly secured around the lower thoracic area of the body. By grasping the free end of the cable and pulling it downwardly, the buttocks are raised vertically such that the weight of the body is substantially wholly supported by the belt and the forces of gravity apply a natural traction to the lower spinal vertebra.

9 Claims, 6 Drawing Figures

18
18c
17
18a
18b
20
28a
30
a
16
22
23
12
15a
21
15
15b
11b
11
11a
24
B
27
26
25
24a
25a 19
17
18c
18b
20
18d
28
32
30
30
21
16
21a
23
23a
23a
22
24
24
12
11
13
15
15
11a
13
B
26
27a
26
25
25a
25b
25
27a
25a

PATIENT OPERATED DEVICE AND METHOD FOR APPLYING TRACTION TO THE LOWER BACK VERTEBRA OF A PATIENT IN A SEATED POSITION

BACKGROUND OF THE INVENTION

The invention to be disclosed is concerned with a device for applying traction to the lower spinal skeletomuscular portions of human beings. It is particularly concerned with a device which is operable by the person using it, and can be utilized while the patient is working at a desk or watching television. There have been numerous attempts to apply traction forces to various parts of the human anatomy and some of these are disclosed in the following prior patents which represent those known to applicant:

3,003,498 Hotas;
4,015,597 Beaver;
3,105,489 Zivi;
4,030,489 Buckner;
3,118,441 George;
4,125,257 Lew;

Among the prior art patents listed is the traction chair disclosed in the Hotas U.S. Pat. No. 3,003,498, wherein the approach is considerably different. In this patent the lower part of the spine of the patient is held stationary and the upper portion of the spine is raised in opposition to the stationary lower portion of the spine. The concept involves the provision of a special chair, to the seat of which a stationary restraint for the lower spinal vertebra of the patient is secured and, as the patent makes clear, an operator is necessary to operate the device for the patient. When this device is in use, the buttocks of the patient remain engaged with the seat of the chair and their weight is directly applied to the seat of the chair.

Similarly, in the Buckner Pat. No. 4,030,489, where a portable device is provided which, when attached to the body permits the patient to walk and move from place to place while wearing the apparatus, the buttocks of the patient remain in engagement with the seat or frame of the device. It is the weight of the upper portion of the body of the patient which is transferred to the frame. In this device, also, the patient sits on the seat or frame, and the buttocks and portions of the body below the so-called thoracic region are in weight-bearing engagement with the seat or frame. Finally, while the theory is to apply an upward force to the belt, it is readily apparent that a patient could not adjust the device to apply such an upward force while seated, and after having fastened the belt which is supplied.

The concept involved in the applicant's system is clearly different, in that the patient, after taking a seated position in a conventional chair, and snugly securing the belt around the lower thoracic area of the body, is then able to apply a natural or "gravity" traction to the lower spinal region by pulling the entire body upwardly from the chair seat such that the weight of the entire body is substantially wholly supported by the belt, and the forces of gravity apply a "natural" traction to the lower spinal region. As will become apparent, this is a different concept in a device of the character contemplated, wherein the patient is able to apply the traction to his own lower spinal vertebra while in a seated position in an available chair or other furniture piece.

BRIEF SUMMARY OF THE INVENTION

The present invention employs a frame which bears against the backrest of an available furniture piece, and hooks over the upper end thereof in a manner to stably support a person having painful, strained, or arthritic back problems which would be exacerbated if the person were inadvertently released to fall and injure an already stressed spinal region. The device is provided with a frame which is configured such that a cable-pulley system is supported above the chair on which the patient is initially seated and grippers are provided which automatically engage and lock, with a downward pull exerted on the cable by the person, such that the entire weight of the body, including the weight of the buttocks of the person, is removed from the seat and the lower spinal area of the person.

One of the primary objects of the invention is to provide a system of the character described wherein the lower spine portion of the body of a person using the device is not placed in a state of compression by the very nature of sitting on the seat and, rather, a gravity-induced traction is applied to the entire lower spinal area while the patient remains in a position akin to a seated position.

Another object of the invention is to provide a comfortable traction-applying system which does not in any way stress the person's spinal region, and, rather, permits the person to, in effect, sit at a desk, or, in effect, sit in a comfortable position for viewing television or engaging in other activity, while relieving the stresses associated with lower back, lumbo-sacral pain.

Still another object of the invention is to provide a system which is of relative simple construction and can be economically manufactured, so that it can be inexpensively purchased by persons in need of such a system.

Another object of the invention is to provide a traction-applying system which does not require the purchase of what essentially is a piece of furniture, but rather provides a system which is readily adaptable to conventional furniture pieces which are already available in the patient's home or occupational setting.

Still another object of the invention is to provide a reliable traction-applying device which can be comfortably and conveniently operated by the patient, and wherein the patient can easily and rapidly release himself from the traction position without risk of injury.

Other objects and advantages of the invention will become apparent by reference to the following specification and to the drawings.

IN THE DRAWINGS

DETAILED DESCRIPTION OF THE INVENTION

Figure 1:
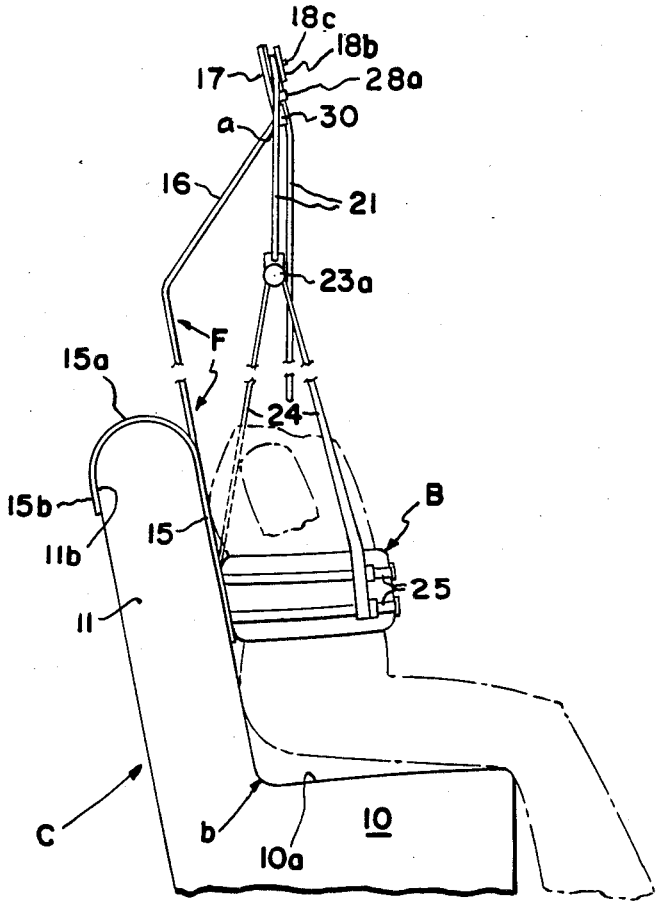
FIG. 1 is a fragmentary, side elevational view showing the schematically represented patient suspended in a natural traction-applying position.
Figure 6:
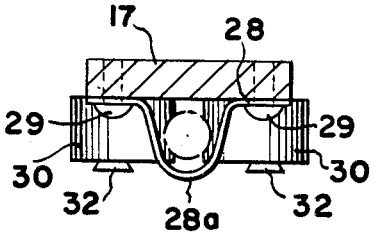
FIG. 6 is a transverse sectional plan view taken on the line 6—6 of FIG. 4.
Figure 2:
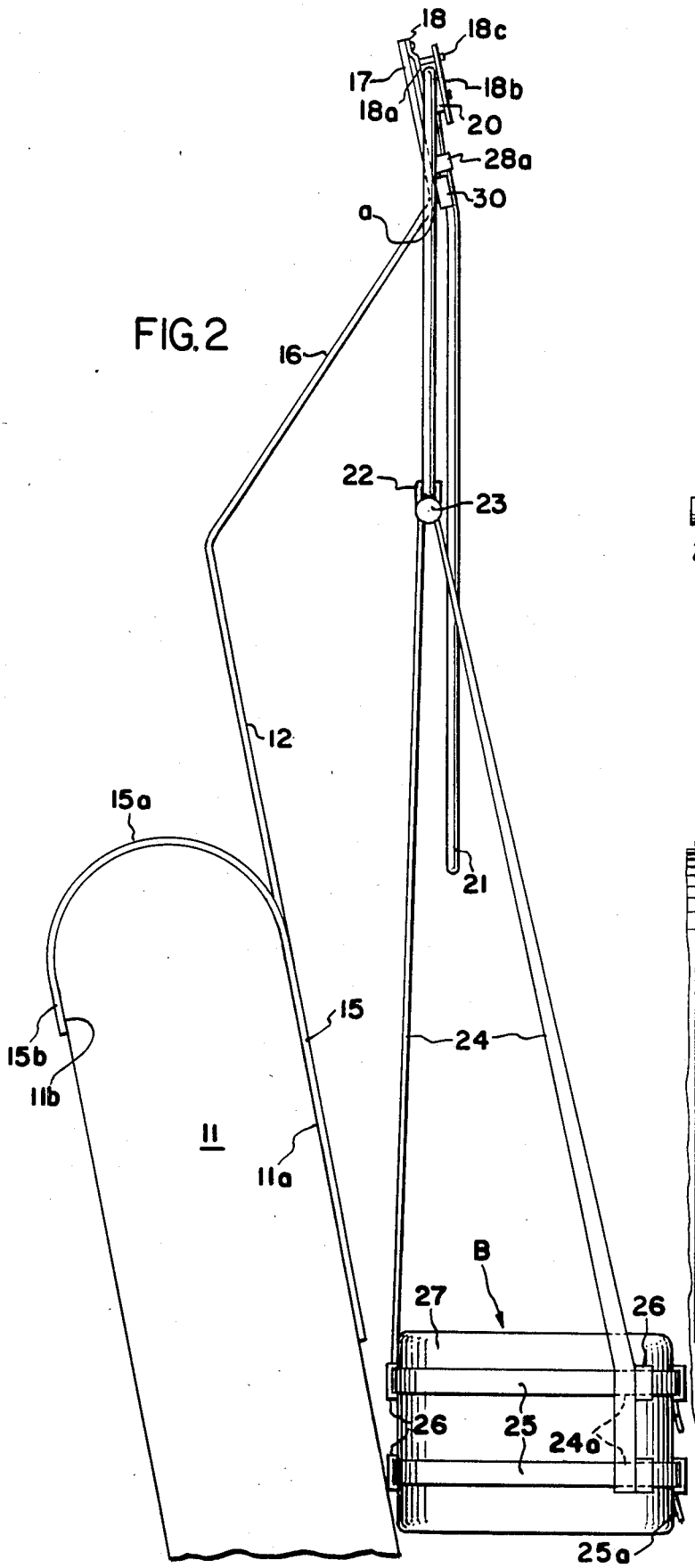
FIG. 2 is a considerably enlarged, fragmentary, side elevational view, showing the elements of the system in more detail.
Figure 3:
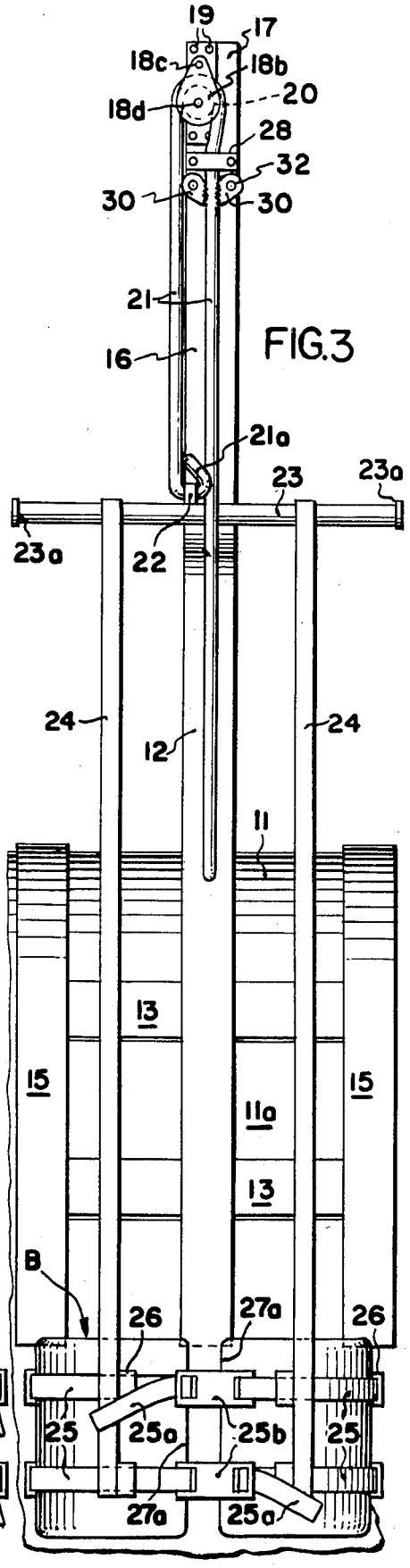
FIG. 3 is front elevational view thereof.

Referring now to the accompanying drawings, and particularly in the first instance to FIGS. 1–3, a conventional upholstered chair, generally designated C, is shown as comprising a horizonal seat portion 10, and a rearwardly inclined backrest portion 11. Legs (not shown) are, of course, provided in the usual manner to support the chair.

The system of the invention includes a frame, generally designated F, which comprises, as perhaps FIGS. 2 and 3 best indicate, a central, vertically rearwardly inclined section 12 in load-bearing engagement with the front surface 11*a* of the backrest portion 11. Integral, transversely extending brace strips 13 connect the section 12 with a pair of integral side strips 15, which also are in load-bearing engagement with the surface 11*a* of the backrest 11, and which have rearwardly curved, upper sections 15*a*, which hook over the upper end of the backrest 11. The sections 15*a* terminate in linear ends 15*b* which have load-bearing engagement with the rear surface 11*b* of the backrest 11, to thus stably support the frame F in position on chair C.

Figure 4:
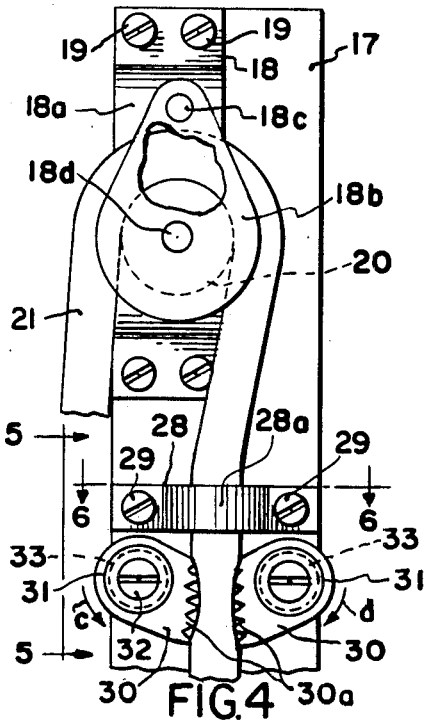
FIG. 4 is a still more enlarged, fragmentary, front elevational view of the upper end of the system, with the operating cable or rope being shown in a locked position between the gripper members.
Figure 5:
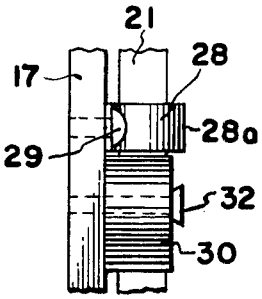
FIG. 5 is a side elevational view taken on the line 5—5 of FIG. 4.

The central section 12 of the frame, which extends upwardly beyond the seat back 11, includes a forwardly extending section 16 which projects to a locus a which substantially vertically aligns with the rear edge b of the chair seat 10. Extending upwardly and slightly rearwardly from the section 16, is a terminal upper end section 17, which, as FIG. 4 perhaps best indicates, supports a pulley mounting bracket 18. The bracket 18 includes a rear wall 18*a*, secured to section 17 as with screws 19, joined to a front wall 18*b* by a pin 18*c*, and an axle 18*d* on which a pulley 20 is rotatably received. The rope 21 is trained around the pulley 20, and at one end is tied as at 21*a* to a central eye member 22 provided on a horizontal rod or beam 23.

A pair of flexible straps 24 are looped over the ends of rod 23, which has enlarged flanges 23*a* to retain them, and each of the straps secures to a padded belt, generally designated B, which will now be more particularly described. The fabric straps 24 are provided with loop portions 24*a* to receive upper and lower, horizontal, belt-enveloping straps 25, which also extend through circumferentially spaced loops 26 provided on the foam pad sections 27, which are configured to be secured around the lower thoracic region of the person using the device. The belt B may consist of two semi-circular pads 27 which have free ends 27*a* at their front and back. At the front, one end 25' of each of the straps 25 is provided with a buckle or lock 25*b* through which the other, free, end 25*a* may be drawn and automatically secured, and, as shown, buckle 25*b* for the lower belt 25 is provided on an end of the belt 25 which is opposite the end to which the upper buckle 27 is secured. With this construction the free ends 25*a* of straps 25 need simply to be pulled in opposite directions tightly, to tightly secure the foam pads 27 in position.

At its opposite end, rope or cable 21 passes under a U-shaped keeper member 28 which is secured to the frame sections 17 by suitable means, such as machine screws 29. Centrally spaced with regard to the keeper 28, and located just below it, are a pair of offset-mounted grippers 30, having rope compressing and gripping teeth 30*a*. The grippers 30 are pivotal on arbors 31, secured to the frame section 17 as with machine screws 32, and torsion springs 33 are connected between the grippers 30 and arbors 32 to strongly bias the grippers 30 to pivot in opposite directions to bite into the compressible rope 21, as indicated by the arrows c and d.

THE OPERATION

As FIGS. 1 and 2 well indicate, the rope or cable 21 is of sufficient length that it is easily within the grasp of a person seated in the chair C. The grippers 30 are necessarily remote from the person and are not accessible. A person desiring to use the traction-applying device will, first of all, hook the portions 15*a* of the straps 15 over the backrest 11 of the chair C, and then will assume a seated position in which the buttocks preferably are all the way to the rear of the chair seat 10 and in engagement with the backrest 11, as well as the seat upper surface 10*a*. In this position the pulley 20 will be located virtually directly above the region a. The user then secures the padded belt portions 27 snugly around his lower thoracic region by drawing the ends 25*a* of the straps 25 through the buckles 25*b*. With the belt B snugly, yet comfortably, encircling the body of the user, it is then only necessary to reengage the rope 21 between the grippers 30 and pull downwardly. The mid-portion 28*a* of keeper 28 maintains the central position of the rope 21, and if the rope is brought into engagement with the teeth 30*a* by pulling it rearwardly and downwardly simultaneously, the grippers 30 are pivoted outwardly and spread to receive the rope 21 between them. The rope 21 is pulled downwardly sufficiently to raise the seat or buttocks of the person using the device to a position in which the surface 10*a* is virtually bearing no weight. The slightly exaggerated position of the body of a patient using the device is illustrated in FIG. 1, from which it can be seen that the buttocks is in contact only with the backrest 11 and the only portion of the body contacting the seat surface 10*a* is a portion of the legs below the knees. Grippers 30 automatically remain engaged to hold the rope.

When the body is suspended in this position, the weight of the trunk of the body below belt B, imposes a natural gravity-induced traction to the lower spinal vertebra which are then free of any compressive forces which otherwise would be induced by the seated position of the chair occupant. The party using the device is comfortable and can function occupationally or recreationally, while undergoing a beneficial traction which alleviates his or her lower back problem and the pain and discomfort associated therewith. To release, it is only necessary for the patient to pull the rope forwardly sharply and remove it from between grippers 30, and permit the body to lower gently.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

What is claimed is:

1. In a patient operated device for applying traction to the lower spinal area of a patient in a seated position in a chair, the combination with the chair comprising:

a. an elongate, generally vertically extending frame having a generally vertically rearwardly inclined first portion adapted to bear against the rearwardly inclined vertical backrest of a chair having also a generally horizontal seat, a second portion extending vertically forwardly from the upper end of the backrest to a locus spaced above the backrest and approximately vertically above the rear edge of the seat, and a third section extending upwardly from said second section generally at said locus;

b. said frame having a rearwardly projecting downwardly open, generally hook-shaped section adapted to fit over the upper end of the backrest including a portion extending downwardly along the rear surface of the backrest opposite the vertically rearwardly inclined portion;

c. an intermediate support arm movable vertically with respect to said frame;

d. a padded belt adapted to be worn around the lower thoracic area of the patient;

e. flexible strips connecting the belt and support arm;

f. a pulley system supported by the said third portion of the frame;

g. a cable trained around said pulley system and connected to said support arm, the cable having a free end adapted to hang down from the pulley system so as to be graspable by the seated patient whereby it can be pulled downwardly to raise the buttocks vertically off the seat such that the weight of the torso is substantially wholly supported by the belt while the belt and spinal area engage the backrest and the front of the seat engages the legs;

h. and a pair of spring biased, spaced apart, pivotally mounted, releasable grippers mounted on said frame at said locus on opposite sides of said free end of the cable, said grippers being biased to pivot toward said cable to cable gripping position but being offset mounted to be spreadable with a downward movement of said cable along said frame, said frame serving as a guide surface for said cable between said grippers and the cable being removable from said grippers with a forwarding movement thereof to free the cable from gripper locked position.

2. The device of claim 1 wherein the other end of said cable is centrally attached to said intermediate support arm and leads up to said pulley system.

3. The device of claim 1 wherein a U-shaped keeper guide on said third section of the frame just above said gripper members enables said cable to be pulled forwardly far enough to disengage from said grippers but maintains the cable vertically centrally located with respect to said grippers so as to be readily reengageable between said grippers.

4. The device of claim 1 wherein said pulley system comprises a single pulley mounted on a bracket supported by said frame.

5. The device of claim 1 wherein said first section of the frame includes a pair of transversely spaced, vertically extending members connected by spanning braces near their ends.

6. A method of self-applying traction to the lower spinal area with an elongate generally vertical frame contoured to fit on the rearwardly and upwardly inclined vertical backrest portion of a chair having a seat, from which the backrest extends upwardly, the frame having an upwardly extending portion with a pulley system mounted thereon at a substantial level about the said backrest, and having a cable trained around said pulley system, a removable belt adapted to be worn around the lower thoracic area of the user and secured to one end of the cable, the other end of the cable being free and being passed through a releaseable gripper device mounted on said frame, to hang therebelow; the steps of;

a. placing the frame on the backrest of the furniture piece such that the pulley system and free end of the cable are above and overlie the seat back;

b. taking a seated position in the chair and snugly securing the belt around the lower thoracic area of the body; and c. grasping the free end of the cable and pulling it downwardly to raise the buttocks vertically off the seat such that the weight of the torso is substantially wholly supported by said belt while the belt and spinal area engage the backrest and the front of the seat engages the underside of the legs adjacent the knees, and the forces of gravity apply a natural traction to the lower spinal region.

d. and locking the cable in the pulled downwardly position.

7. The method of claim 6 wherein the downward pull on the cable is released to automatically lock the cable in said gripper and sustain the natural traction position of the user.

8. The method of claim 7 wherein traction is released by moving the free end of the cable forwardly to free it from the locking action of the gripper device.

9. In a patient operated device for applying traction to the lower spinal area of a patient in a seated position in a chair, the combination comprising:

a. an elongate, generally vertically extending frame having a generally vertical first portion adapted to bear against and secure to a chair having a generally horizontal seat with an upwardly and rearwardly inclined vertical backrest, and a second portion extending vertically from the upper end of the seat to a locus spaced above the backrest and approximately vertically above the rear edge of the seat;

b. said frame having a rearwardly projecting downwardly open, generally hook-shaped section adapted to fit over the upper end of the backrest including a portion extending downwardly along the rear surface of the backrest opposite the said first vertical portion;

c. a padded belt adapted to be worn around the lower thoracic area of the patient;

d. flexible straps connecting to the belt;

e. a cable support system supported by the upper end of said frame;

f. a cable trained around said cable support system and connected to said straps at one end to suspend the belt, the cable having a free end adapted to hang down from the cable support system so as to be graspable by the seated patient whereby it can be pulled downwardly to raise the buttocks vertically off the seat such that the weight of the torso is substantially wholly supported by the belt while the belt and spinal area engage the backrest and the front of the seat engages the legs;

g. and a pair of spring biased, spaced apart, pivotally mounted, releasable grippers mounted on said frame at said locus on opposite sides of said free end of the cable, said grippers being biased to pivot toward said cable to cable gripping position but being offset mounted to be spreadable with a downward movement of said cable along said frame, said frame serving as a guide surface for said cable between said grippers and the cable being removable from said grippers with a forwarding movement thereof to free the cable from gripper locked position.

* * * * *

UNITED STATES PATENT AND TRADEMARK OFFICE

CERTIFICATE OF CORRECTION

PATENT NO. : 4,603,689

DATED : August 5, 1986

INVENTOR(S) : John A. Horner

It is certified that error appears in the above-identified patent and that said Letters Patent is hereby corrected as shown below:

In column 6, line 33, delete "seat" and insert -- backrest -- .

Signed and Sealed this

Twenty-fifth Day of November, 1986

*Attest:*

DONALD J. QUIGG

*Attesting Officer* *Commissioner of Patents and Trademarks*